US009756881B2

(12) United States Patent
Grandin De L'eprevier et al.

(10) Patent No.: US 9,756,881 B2
(45) Date of Patent: Sep. 12, 2017

(54) GARMENT DESIGNED TO REDUCE CELLULITE BY MICRO-MASSAGE

(71) Applicant: DECATHLON, Villeneuve d'Ascq (FR)

(72) Inventors: Laurie Grandin De L'eprevier, La Medeleine (FR); Sophie Piechaud, Lille (FR); Florence Agape, Roubaix (FR)

(73) Assignee: DECATHLON, Villeneuve d'Ascq (FR)

( * ) Notice: Subject to any disclaimer, the term of this patent is extended or adjusted under 35 U.S.C. 154(b) by 24 days.

(21) Appl. No.: 14/879,491

(22) Filed: Oct. 9, 2015

(65) Prior Publication Data

US 2016/0100636 A1 Apr. 14, 2016

(30) Foreign Application Priority Data

Oct. 10, 2014 (FR) ..... 14 59760

(51) Int. Cl.

| | |
|---|---|
| ***A41D 1/06*** | (2006.01) |
| ***A41D 13/00*** | (2006.01) |
| ***A41D 27/10*** | (2006.01) |
| ***A41D 31/00*** | (2006.01) |
| ***A61H 7/00*** | (2006.01) |

(52) U.S. Cl.

CPC ..... *A41D 1/06* (2013.01); *A41D 13/0017* (2013.01); *A41D 27/10* (2013.01); *A41D 31/00* (2013.01); *A61H 7/001* (2013.01); *A61H 7/007* (2013.01); *A41D 2400/322* (2013.01); *A61H 2201/164* (2013.01); *A61H 2201/165* (2013.01); *A61H 2201/1628* (2013.01); *A61H 2201/1635* (2013.01); *A61H 2207/00* (2013.01)

(58) Field of Classification Search

CPC ..... A41D 1/06; A41D 27/10; A41D 13/0015; A41D 13/08; A41B 1/00; A61F 13/0273; A61F 13/08

USPC ..... 2/227, 115, 125, 69, 16; 602/75, 63, 5

See application file for complete search history.

(56) References Cited

U.S. PATENT DOCUMENTS 3,888,242 A * 6/1975 Harris ..... A61H 9/0078 36/141
3,892,239 A * 7/1975 Masso Remiro ..... A61F 13/06 601/1

(Continued)

FOREIGN PATENT DOCUMENTS

EP 1713352 B1 10/2006
WO WO 2005/079610 A1 9/2005

*Primary Examiner* — Tejash Patel

(74) *Attorney, Agent, or Firm* — Marshall, Gerstein & Borun LLP

(57) ABSTRACT

A garment having at least one sleeve, intended to cover a part of the body of a wearer, the sleeve having at least one region, the inner surface of which is equipped with a network of picots, the sleeve being designed to be able to exert compressive stress from said picots onto the skin of the body part that is intended to be positioned facing said network, the picots each having a trigonal base and being distributed in the network so as to form alveoli between adjacent picots, the sleeve being designed such that the picots can exert pressure on the skin great enough to form a skin protrusion in at least one alveolus in order to micro-massage the protrusion during relative movements taking place between the network and the body part.

13 Claims, 3 Drawing Sheets

(56) References Cited

U.S. PATENT DOCUMENTS

| | | | | |
|---|---|---|---|---|
| 5,794,266 | A * | 8/1998 | Han | A41D 19/0062 2/159 |
| 6,656,141 | B1 * | 12/2003 | Reid | A61B 17/1325 601/134 |
| 7,135,007 | B2 * | 11/2006 | Scott | A61F 13/085 602/75 |

* cited by examiner

GARMENT DESIGNED TO REDUCE CELLULITE BY MICRO-MASSAGE

The present application claims priority to French Patent Application No. FR-1459760, filed Oct. 10, 2014. The priority application, FR-1459760, is hereby incorporated by reference.

FIELD OF THE INVENTION

The invention relates to a garment comprising at least one sleeve having an elasticity designed to be able to exert compressive stress on the part of the body that it is intended to cover.

BACKGROUND OF THE INVENTION

It in particular applies to garments designed for practicing sports activities such as fitness, during which the limbs of the wearer are subject to repeated flexion and extension movements, which in particular result in the garment moving in relation to the body of the wearer.

In order to fight against cellulite, some manufacturers have developed garments generating physiological effects on the body by application of a compressive force on the skin, in particular encouraging venous return and lymphatic drainage, combined with local mechanical and/or chemical stimulation of the skin tissue.

There exist, for example, compression tights the fabric material of which is equipped with micro-capsules containing active substances that are released on contact with the skin, such as caffeine associated with shea butter to encourage fat burning. Compression tights have also been produced using fibres integrating microbeads containing ceramic powder capable of emitting infrared radiation in order to thermally stimulate cutaneous microcirculation.

However, such tights are made to be very tight-fitting, which is uncomfortable and makes them little suited to practicing a physical activity encouraging circulation and fat loss. Moreover, the effectiveness of garments integrating active substances is limited in time, as said substances are sensitive to the washing of said garments.

A compression garment such as tights or a T-shirt is also known in document EP-1 713 352, the inner surface of which is equipped with discrete, hemispherical, silicone picots intended to apply, when practicing sport, an anti-cellulite action through exerting pressure and massaging on the body areas with which said picots are in contact.

However, this solution is not entirely satisfactory, as the geometry of the picots does not allow for the combined exertion of pressure and pinching of the skin between said picots, which suffice for an effective micro-massaging effect. Furthermore, document EP-1 713 352 provides a space between the picots to guarantee aeration of the body area that they cover, thus limiting the massaging effect from the picots.

The invention aims to perfect the prior art by proposing in particular a garment designed to be able to apply an improved micro-massaging action on localised parts of the body of the wearer, in particular when practicing a physical activity, in order to benefit from an anti-cellulite effect on said body parts.

For this purpose, the invention proposes a garment comprising at least one sleeve intended to cover a part of the body of a wearer, said sleeve having at least one region, the inner surface of which is equipped with a network of picots, said sleeve being designed to be able to exert compressive stress from the picots onto the skin of the body part that is intended to be positioned facing the network, said picots each having a trigonal base and being distributed in the network so as to form alveoli between adjacent picots, said sleeve being designed such that the picots can exert pressure on the skin great enough to form a skin protrusion in at least one alveolus in order to micro-massage said protrusion during relative movements taking place between said network and said body part.

Other features and advantages of the invention will become apparent in the following description, which is given with reference to the appended figures, in which:

DETAILED DESCRIPTION OF THE PREFERRED EMBODIMENTS

With reference to these figures, the following text describes a garment having at least one sleeve 1 intended to cover a part of the body of a wearer, said garment can be worn on the upper and/or lower part of the body, in particular around a limb of said body.

In particular, the sleeve 1 is made from an elastic material designed to maintain said sleeve tightly around the body part, the garment can be of a technical type and adjusted to the body of the wearer in order to improve comfort and ease body movements during physical exercise.

Advantageously, the elasticity of the material is chosen so that the garment does not cause discomfort and does not provide additional mechanical constraints during repetitive body movements of the wearer. For this purpose, the elastic material constituting the sleeve 1 can be a fabric or knit fabric made from synthetic threads, the resilience of which is sufficient for applying compressive stress to the body part, said material can be, for example, made from threads with a polyamide and/or elastane base.

Figure 1:
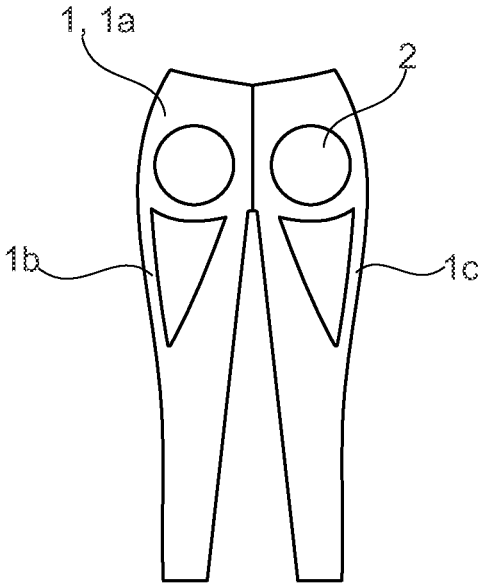
FIG. 1 is a schematic representation in rear view of tights according to one embodiment of the invention, showing the positioning of the networks of picots in the regions covering the pelvis and thighs of the wearer.

According to the embodiment represented in FIG. 1, the garment is intended to be worn on the lower part of the body of the wearer, having the shape of a pair of tights designed to cover said lower body part, from the waist to the ankles of said wearer.

The garment has an upper sleeve 1*a* for covering the pelvis, including a belt portion intended to be worn around the waist of the wearer and a portion intended to cover the buttocks and upper thighs of said wearer. The garment also has two sleeves 1*b*, 1*c* for respectively covering one leg of the wearer, each of said sleeves extending below the upper sleeve 1*a* to surround said leg.

However, the invention is not limited to this embodiment, in particular with regard to the dimensions of the garment and the body parts that it covers, said garment particular can be a T-shirt, a long-sleeved vest, a pair of shorts or a breeches.

At least one sleeve 1 of the garment has one or several regions, the inner surface of which is equipped with a network 2 of picots 3 in relief designed, during the wearer's movements and in combination with the stretchability properties of said sleeve against the body part of said wearer, to provide said garment with a function, in particular an anti-cellulite function, by a micro-massaging action on said body part by said network.

The regions equipped with networks 2 of picots 3 are positioned opposite the determined body parts, in particular those most concerned by cellulite and the orange peel effect resulting therefrom, in order to provide localized stimulation and treatment. Depending on the body part covered, the regions may be equipped with one or multiple networks 2 of different dimensions and configurations for an action adapted to suit said body part.

With regard to FIG. 1, each sleeve 1*a*-1*c* comprises at least one region, the inner surface of which is equipped with a network 2 of picots 3, said region being positioned in an upper, rear area of said sleeve.

The upper sleeve 1*a* therefore comprises two networks 2 positioned in a region respectively covering one buttock of the wearer, the leg-covering sleeves 1*b*, 1*c* each comprising a network 2 positioned in a region respectively covering one thigh of said wearer.

The garment's action can be extended by providing other regions equipped with such networks 2. For example, each sleeve 1*b*, 1*c* can include a frontal region of the thigh and/or a lower rear region, the inner surface of which comprises such a network 2, which is intended to be in contact respectively with the front surface of the thigh of the wearer and the rear surface of the wearer's calves.

Each sleeve 1 is designed to be able to apply compressive stress at the regions from the picots 3 onto the skin of the body part that is intended to be positioned facing the network 2, resulting in the driving of said picots into said skin. Preferably, the picots 3 are made from at least one material that adheres on contact with the skin, for example a silicone or elastomer material, having a coefficient of friction with the skin that encourages the maintenance of said picots in a compressive position against said skin, in particular during relative movements between the network 2 and the body part.

The network 2 of picots 3 can be directly formed on the inner surface of the sleeve 1 via a fastening technique for fabrics, for example by coating. However, in order to ease the garment manufacturing process, each network 2 is preferably formed on an association support 4, which is fixed on the inner surface of the corresponding region, said network extending over all or part of said support. The support 4 is advantageously made in one piece with the picots 3 and from an identical material, for example by molding, said support being associated on the inner surface of the sleeve 1, for example by thermofusing or stitching.

Alternatively, the support 2 can be made from a fabric material on which the picots 3 are produced, in particular by coating. In another alternative embodiment, the network 2 of picots 3 can be produced when manufacturing the garment, for example by three-dimensional knitting.

According to the embodiment represented, the networks 2 of the upper sleeve 1*a* are formed on a circular support 4, the networks 2 of the leg-covering sleeves 1*b*, 1*c* being formed on trigonal supports 4 extending along the rear thigh-covering regions.

Each picot 3 has a trigonal base 5 by being distributed in the network 2 to form alveoli 6 between adjacent picots 3. In particular, each sleeve 1 is designed so that the picots 3 can apply pressure to the skin great enough to form a skin protrusion in at least one alveolus 6 in order to micro-massage said protrusion during relative movements between the network 2 and the corresponding body part.

The network 2 thus has an alternating of picots 3 with a trigonal base 5 and of alveoli 6, which is designed to be able to apply stresses to compress and pinch the skin during the wearer's movements, for example when practicing sports, in order to provide a micro-massage, whereby the trigonal geometry of said bases provides for a three-directional micro-massage for optimum effectiveness.

In particular, when the garment is worn during physical exercise, such a network 2, by driving the picots 3 into the skin and by the movements of said network in relation to the body of the wearer, reproduces a massaging action known as the "palpate and roll" technique in each region of said garment, thus smoothing the skin by durably reducing cellulite, in particular by breaking up fat deposits, draining and activating blood and lymphatic circulation. In particular, the network 2 can move on the skin and/or with the skin in relation to the cellulite.

According to the embodiments represented, the network 2 has an overlay of rows of picots 3 extending along a direction. The rows can include a different number of picots 3, in particular depending on the geometry of the association support 4.

Figure 2A:
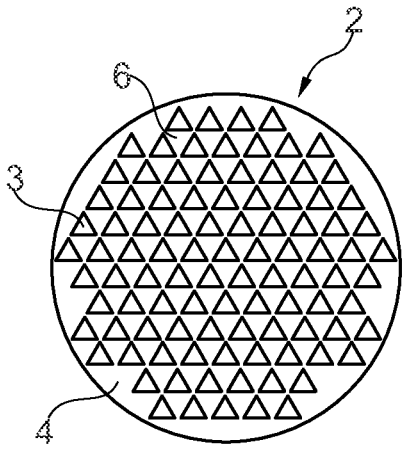
FIG. 2*a* is a top magnified view of a network of picots provided in the pelvic region of the tights of FIG. 1.
Figure 2B:
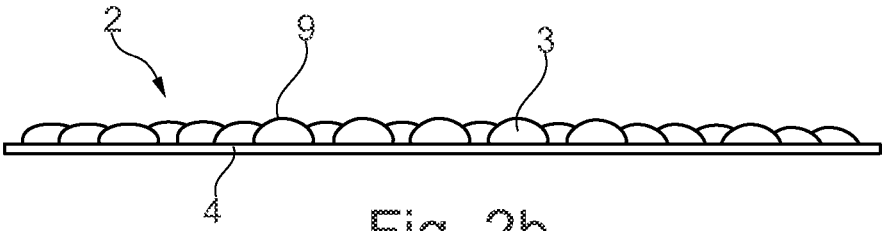
FIG. 2*b* is a side view of the magnified view of the network of picots illustrated in FIG. 2*a;*
Figure 3:
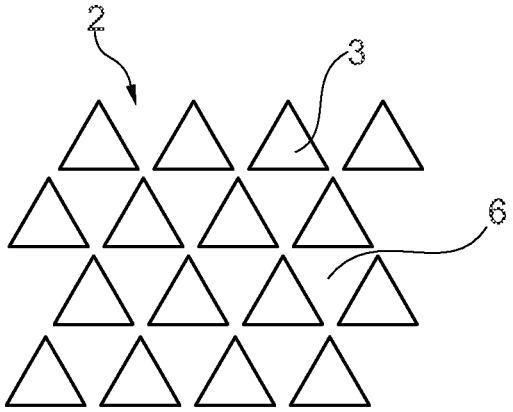
FIG. 3 schematically represents an area of the network of picots of FIGS. 2*a* and 2*b;*

Moreover, the network 2 can be discrete by having adjacent picots 3 that are spread in at least one direction, for a greater freedom of distortion of said picots in relation to each other. With reference to FIGS. 2 and 3, an embodiment is described having a network 2, the bases 5 of the picots 3 of which are spaced apart from each other at their corners 7.

In order to provide for the effective pinching of the skin in the alveoli 6, a distance is provided between the adjacent picots 3, which is less than 75% of the dimension of their base 5 in the direction of spreading.

Figure 4:
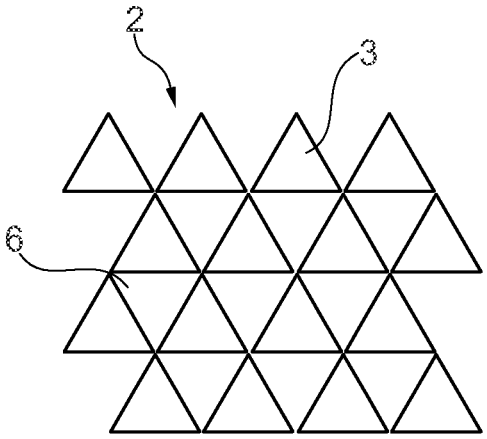
FIG. 4 schematically represents an alternative to the network of picots represented in FIG. 3.

Alternatively, the adjacent picots 3 can also be linked in the network 2 via at least one corner 7 of their base 5. With reference to FIG. 4, the network 2 forms a continuous trellis having adjacent picots 3 in contact at the corners 7 of their base 5 so as to form alveoli 6 that are closed at the level of said bases.

In FIGS. 2 to 4, the picots 3 are positioned in staggered rows, whereby two consecutive picots 3 in a row and two consecutive picots 3 in a column are respectively spaced transversally and longitudinally by an alveolus 6. In this configuration, the picots 3 are distributed in the network 2 according to a 3-fold symmetry, each alveolus 6 being defined between three adjacent picots 3, encouraging the back-and-forth distortion of the protrusions formed in said alveoli to destroy fatty cells.

Figure 5:
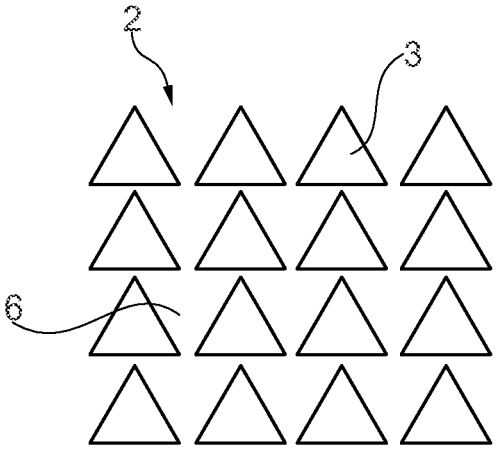
FIG. 5 schematically represents another alternative to the network of picots represented in FIG. 3.

Alternatively, the picots 3 can be distributed in the network 2 according to a 4-fold symmetry by being positioned aligned in rows and columns (FIG. 5). In this configuration, the bases 5 of two consecutive picots 3 in a column respectively have a corner 7 and a side 8 facing each other, whereby the alveoli 6 are respectively defined between four picots 3.

In order to form a skin protrusion sufficient for the micro-massaging action while guaranteeing optimal wearing comfort, the picots 3 can have a base 5 with a maximum dimension not exceeding 15 mm and a height not exceeding 10 mm. In particular, the height of the picots 3 can be 2.5 mm, whereby the maximum dimension of the base is 7 mm.

The invention is not limited to a single configuration, nor to fixed dimensions of the picots 3 in a network 2. The network 2 can, for example, have discrete areas of spread picots 3 and continuous areas of linked picots 3. Picots 3 can also be provided for with dimensions, in particular the height, designed to form a network 2 of anatomical relief in order to optimise wearing comfort and the comfort of the micro-massage treatment.

Furthermore, the shape of the trigonal base 5 and the geometry of the picots 3 can vary from one network 2 to another and/or from one type of garment to another, depending, for example, on the desired micro-massaging pressure.

Advantageously, the picots 3 have a pyramidal geometry which extends from their respective base 5 to a tip 9, said picots each having three walls 10 spaced by an edge 11. The alveoli 6 are thus formed between the walls 10 opposite the adjacent picots 3, in particular between three walls 10 of a picot 3 respectively, when the distribution of said picots is produced according to a 3-fold symmetry.

In the same network 2, the picots 3 can have different dimensions and pyramidal geometries for exerting higher or lower pressures and for forming larger or smaller protrusions depending on the body parts to be treated.

In particular, the pyramidal geometry of the picots 3 results in a convergence of the alveoli 6 inwards, which, in combination with the edges 11 of said picots, encourages the maintenance of the skin protrusions in said alveoli, in particular during movements of the wearer, thus generating a relative movement of said protrusions in relation to the body parts into which the picots 3 are driven, to provide the desired micro-massaging action.

Figure 6A:
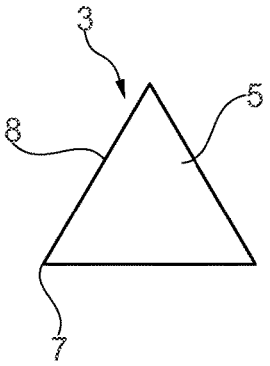
FIG. 6*a* is a schematic representation of the base, or a bottom view, of an individual picot of FIGS. 3*a* to 5.
Figure 7A:
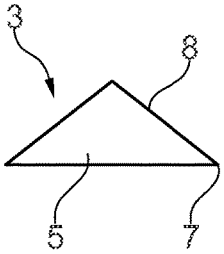
FIG. 7*a* is a schematic representation of a first alternative embodiment of the base of a picot.
Figure 7B:
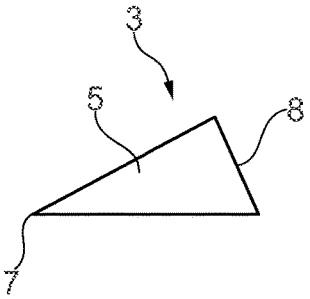
FIG. 7*b* is a schematic representation of a second alternative embodiment of the base of a picot.

With reference to FIG. 6*a*, the picots 3 have a substantially equilateral triangular base 5, whereby the sides 8 of said base are rectilinear. Alternatively, the base 5 of the picots 3 can be triangular by being substantially isosceles (FIG. 7*a*) or scalene (FIG. 7*b*).

Figure 7C:
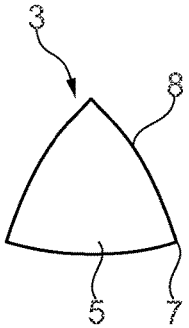
FIG. 7*c* is a schematic representation of a third alternative embodiment of the base of a picot.

In one embodiment, the base 5 can have at least one convex side 8. With reference to FIG. 7*c*, the picot 3 comprises a trigonal base 5 having three convex sides 8, resulting in a more significant pinching of the skin protrusions positioned in the adjacent alveoli 6.

Figure 8A:
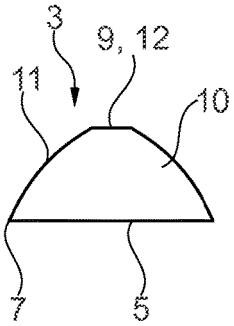
FIG. 8*a* is a schematic representation of a first alternative embodiment of the wall of a picot.
Figure 8B:
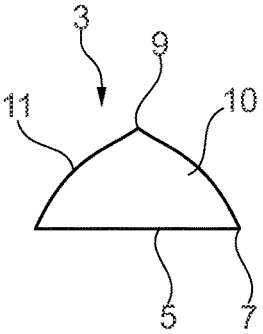
FIG. 8*b* is a schematic representation of a second alternative embodiment of the wall of a picot.
Figure 8C:
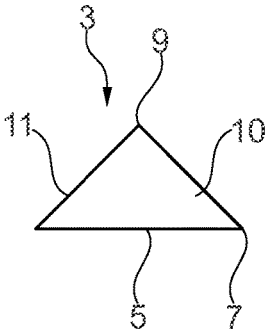
FIG. 8*c* is a schematic representation of a third alternative embodiment of the wall of a picot.

Moreover, the picots 3 can have at least one convex wall 10 to modulate the micro-massaging action, in particular to obtain an optimal compromise between the effectiveness of said action and the wearing comfort. Picots 3 can also be provided with walls 10 joining together into a pointed tip 9 to encourage the adherence of the network 2 on the skin and to better maintain the driven-in position of said picots, whereby the edges 11 of said walls can be convex (FIG. 8*b*) or rectilinear (FIG. 8*c*).

Figure 6B:
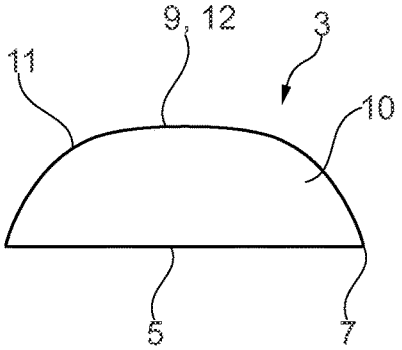
FIG. 6*b* is a schematic representation of the wall, or a side view, of the individual picot represented in FIG. 6*a;*

Alternatively, the walls 10 of a picot 3 can each extend from the base 5 of said picot towards a pointed tip 9, said tip forming an upper wall 12 intended to support said picot on the skin. In particular, a picot 3 can have convex walls 10 connected to a rounded upper wall 12, which extends in a continuous manner with said convex walls (FIG. 6*b*) or to a substantially flat upper wall 12 (FIG. 8*a*).

The invention claimed is:

1. A garment comprising at least one sleeve, intended to cover a part of the body of a wearer, said sleeve having at least one region, the inner surface of which is equipped with a network of picots, said sleeve being designed to be able to exert compressive stress from any picots of said network of picots onto the skin of the body part that is intended to be positioned facing said network, said garment being wherein each picot of said network of picots has a pyramidal geometry which extends from a trigonal base to a tip, having three walls spaced by an edge, said picots of the network of picots being distributed in the network so as to form alveoli between adjacent picots, said sleeve being designed such that the picots can exert pressure on the skin great enough to form a skin protrusion in at least one alveolus of said alveoli in order to micro-massage said protrusion during relative movements taking place between said network and said body part, and each of said alveoli being formed between opposing walls of three adjacent picots of the network of picots.

2. The garment according to claim 1, and the adjacent picots are linked in the network via at least one corner of their base.

3. The garment according to claim 1, and the adjacent picots are spread in at least one direction.

4. The garment according to claim 3, and the distance of spread is less than 75% of the dimension of the base of the picots in the direction of spreading.

5. The garment according to claim 1, and the picots are distributed in the network according to a 3-fold symmetry.

6. The garment according to claim 1, and the picots have a substantially equilateral base.

7. The garment according to claim 1, and the picots have a blunt tip in order to form an upper wall supporting them on the skin of the wearer.

8. The garment according to claim 1, and the picots are made from at least one material that adheres on contact with the skin of the wearer.

9. The garment according to claim 1 and the picots have a base with a maximum dimension not exceeding 15 mm and a height not exceeding 10 mm.

10. The garment according to claim 1, and the network is formed on an association support on the inner surface of the sleeve.

11. The garment according to claim 1, and the sleeve is made from an elastic material, the resilience of which is sufficient for applying compressive stress to the body part of the wearer.

12. The garment according to claim 1, and it is intended to be worn on the lower part of the body of the wearer, the garment having two sleeves for respectively covering one leg, as well as one sleeve for covering the pelvis of the wearer.

13. The garment according to claim 12, and each sleeve comprises at least one region, the inner surface of which is equipped with a network of picots in relief, said region being positioned in an upper rear area of said sleeve.

* * * * *